US011480927B2

(12) United States Patent
Nozawa

(10) Patent No.: US 11,480,927 B2
(45) Date of Patent: Oct. 25, 2022

(54) ELECTRONIC WATCH

(71) Applicant: SEIKO EPSON CORPORATION, Tokyo (JP)

(72) Inventor: Toshiyuki Nozawa, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 367 days.

(21) Appl. No.: 16/787,242

(22) Filed: Feb. 11, 2020

(65) Prior Publication Data

US 2020/0257248 A1 Aug. 13, 2020

(30) Foreign Application Priority Data

Feb. 12, 2019 (JP) ..... JP2019-022338

(51) Int. Cl.
*G04B 47/06* (2006.01)
*G04G 21/02* (2010.01)

(52) U.S. Cl.
CPC ..... *G04B 47/065* (2013.01); *G04G 21/02* (2013.01)

(58) Field of Classification Search
CPC ..... G04B 47/065; G04G 21/02
USPC ..... 368/14; 324/202; 33/271
See application file for complete search history.

(56) References Cited

U.S. PATENT DOCUMENTS 4,977,509 A * 12/1990 Pitchford ..... G06F 15/025 702/138
5,596,551 A * 1/1997 Born ..... G04G 21/02 33/271
7,912,640 B2 3/2011 Okeya
9,030,192 B2 * 5/2015 Oliver ..... G01C 17/38 324/202
10,338,154 B2 * 7/2019 Sekitsuka ..... G01R 33/0029
10,338,536 B2 7/2019 Nozawa
(Continued)

FOREIGN PATENT DOCUMENTS

JP H06-3147 A 1/1994
JP 2004-286613 A 10/2004
(Continued)

OTHER PUBLICATIONS

Ishibashi Takayuki Imaging Device and Imaging Method for Quantitatively Displaying in Color Magnetic Field Distribution Using Magnetooptic Imaging Plate Feb. 22, 2018 Univ Nagaoka Technology JP 2018028519 A figure 4, pp. 14-18 English.*
(Continued)

*Primary Examiner* — Prabodh M Dharia
(74) *Attorney, Agent, or Firm* — Oliff PLC

(57) ABSTRACT

An electronic watch includes a display surface, a magnetic sensor including a first detection axis and a second detection axis orthogonal to the first detection axis, with the first detection axis and the second detection axis being disposed in a plane parallel to the display surface, a correction unit configured to correct an error due to an offset magnetic field included in a detection value of the magnetic sensor, a calculation unit configured to calculate a bearing and magnetic intensity, based on a value acquired by correcting the detection value by the correction unit, and a display unit configured to cause the display surface to display the bearing and the magnetic intensity that are calculated by the calculation unit to be displayed.

8 Claims, 7 Drawing Sheets

(56) References Cited

U.S. PATENT DOCUMENTS

| | | | | |
|---|---|---|---|---|
| 2011/0004450 | A1* | 1/2011 | Mishelevich | A61N 2/02 703/2 |
| 2017/0277128 | A1* | 9/2017 | Nozawa | G04G 9/0076 |
| 2018/0275612 | A1 | 9/2018 | Nozawa | |

FOREIGN PATENT DOCUMENTS

| | | | |
|---|---|---|---|
| JP | 2005-291935 | A | 10/2005 |
| JP | 2014-182062 | A | 9/2014 |
| JP | 2017-58216 | A | 3/2017 |
| JP | 6119342 | B2 | 4/2017 |
| JP | 2017-181091 | A | 10/2017 |
| JP | 2018-159677 | A | 10/2018 |

OTHER PUBLICATIONS

Ishibashi Takayuki Imaging Device and Imaging Method for Quantitatively Displaying in Color Magnetic Field Distribution Using Magnetooptic Imaging Plate Feb. 22, 2018 Univ Nagaoka Technology JP 2018028519 A figure 4, pp. 14-18 Japanese.*

Okutsu Akihiko Electronic Apparatus and Calibration Program Apr. 21, 2016 Fujitsu LTD JP 2016057183 A pp. 1-18 English.*

Okutsu Akihiko Electronic Apparatus and Calibration Program Apr. 21, 2016 Fujitsu LTD JP 2016057183 A pp. 1-18 Japanese.*

* cited by examiner

| MAGNETIC INTENSITY \|B\| | AMPLITUDE OF POINTER |
|---|---|
| $\lvert B \rvert < 15\mu T$ | 4 step |
| $15\mu T \leqq \lvert B \rvert < 25\mu T$ | 3 step |
| $25\mu T \leqq \lvert B \rvert < 35\mu T$ | 2 step |
| $35\mu T \leqq \lvert B \rvert < 45\mu T$ | 1 step |
| $\lvert B \rvert \geqq 45\mu T$ | 0 |

FIG. 5

ELECTRONIC WATCH

The present application is based on, and claims priority from JP Application Serial Number 2019-022338, filed Feb. 12, 2019, the disclosure of which is hereby incorporated by reference herein in its entirety.

BACKGROUND

1. Technical Field

The present disclosure relates to an electronic watch.

2. Related Art

JP-A-2017-181091 discloses an electronic watch having a compass function of measuring a bearing by a magnetic sensor. In JP-A-2017-181091, due north can be acquired by calculating a direction of a geomagnetic field vector, based on a horizontal component of a geomagnetic field measured by a biaxial magnetic sensor, acquiring magnetic north, and then correcting the magnetic north with declination at a measurement point.

However, in JP-A-2017-181091, when a bearing is measured by using the compass function, accuracy of the compass function may decrease in an area in which a horizontal component of the geomagnetic field is small, for example. In other words, in JP-A-2017-181091, there is a problem in that, although the accuracy of the compass function may vary depending on an area in which a bearing is measured, a user cannot perceive the change in the accuracy.

SUMMARY

An electronic watch according to the present disclosure includes a display surface, a magnetic sensor including a first detection axis and a second detection axis orthogonal to the first detection axis, the first detection axis and the second detection axis being disposed in a plane parallel to the display surface, a correction unit configured to correct an error due to an offset magnetic field included in a detection value of the magnetic sensor, a calculation unit configured to calculate a bearing and magnetic intensity, based on a value acquired by correcting the detection value by the correction unit, and a display unit configured to cause the display surface to display the bearing and the magnetic intensity that are calculated by the calculation unit.

In the electronic watch according to the present disclosure, a first pointer configured to indicate the bearing and a second pointer configured to indicate the magnetic intensity may be provided.

In the electronic watch according to the present disclosure, an indicator configured to indicate the magnetic intensity may be displayed on the display surface.

In the electronic watch according to the present disclosure, a first pointer configured to indicate the bearing and the magnetic intensity may be provided, and the display unit may indicate the magnetic intensity by the first pointer by changing an amplitude of the first pointer in accordance with the magnetic intensity.

In the electronic watch according to the present disclosure, a first pointer configured to indicate the bearing and the magnetic intensity and an operation unit may be provided, and the display unit may be configured to be able to switch display by the first pointer between the bearing and the magnetic intensity when the operation unit is operated.

BRIEF DESCRIPTION OF THE DRAWINGS

FIG. 5 is a diagram illustrating a relationship between magnetic intensity and an amplitude of a seconds hand.

DESCRIPTION OF EXEMPLARY EMBODIMENTS

First Exemplary Embodiment

An electronic watch 1 according to a first exemplary embodiment of the present disclosure will be described below with reference to the drawings.

Figure 1:
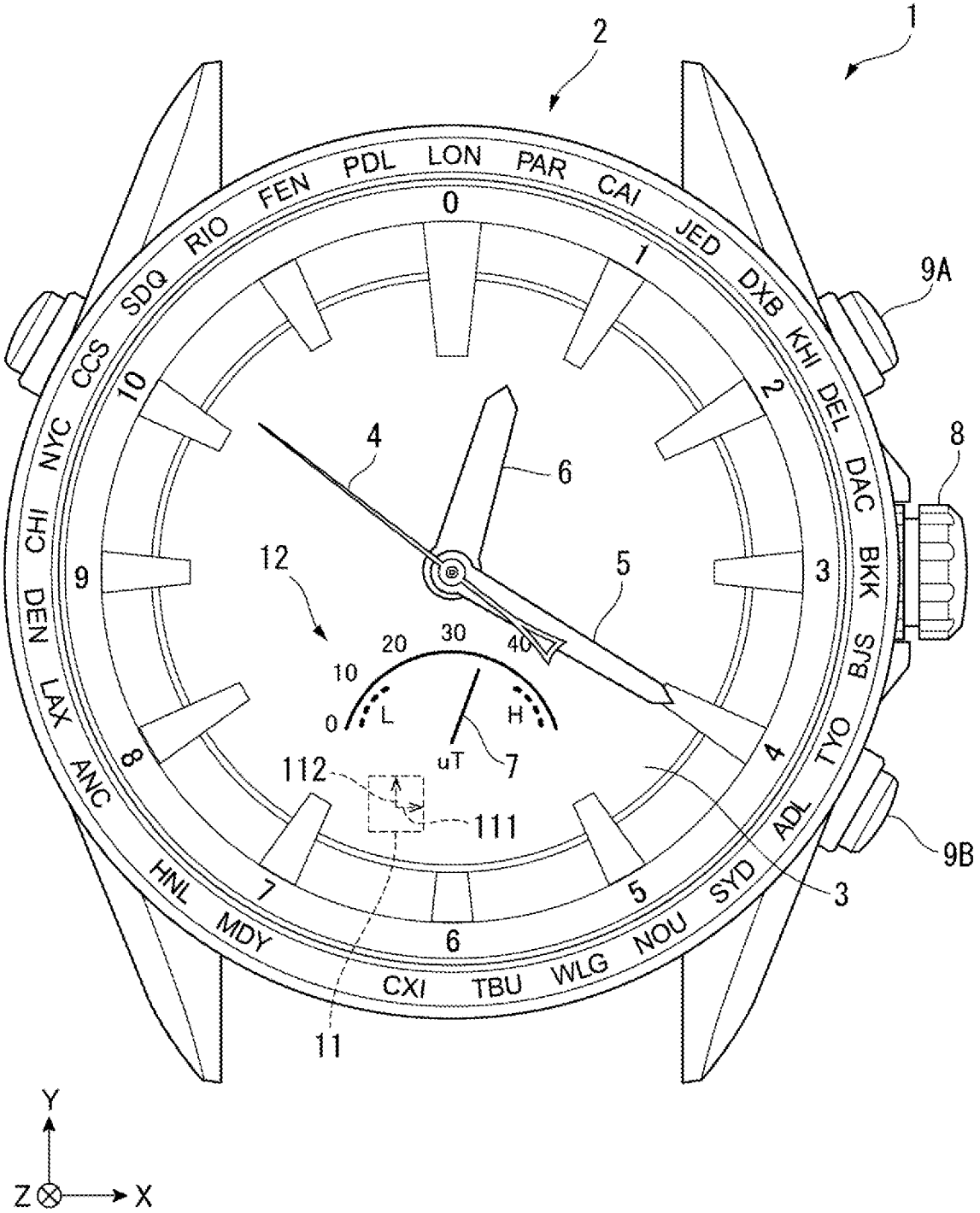
FIG. 1 is a front view illustrating an electronic watch according to a first exemplary embodiment.

FIG. 1 is a front view illustrating the electronic watch 1.

Figure 2:
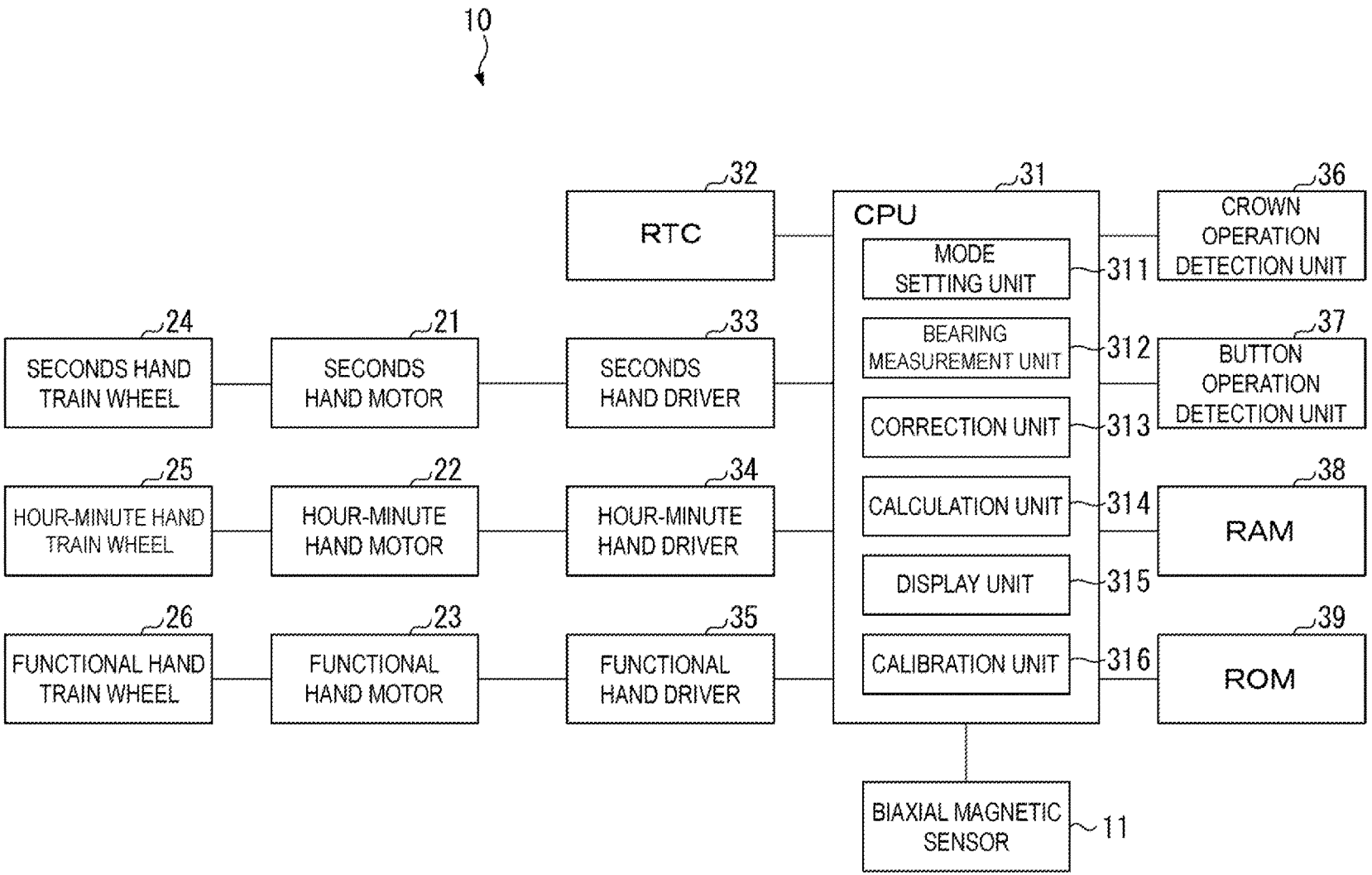
FIG. 2 is a block diagram illustrating a schematic configuration of a movement according to the first exemplary embodiment.

As illustrated in FIG. 1, the electronic watch 1 includes an outer case 2, a dial 3, a seconds hand 4, a minute hand 5, an hour hand 6, a functional hand 7, and a movement 10 illustrated in FIG. 2.

Further, the outer case 2 is provided with a crown 8, an A button 9A, and a B button 9B.

The dial 3 is formed in a disc shape. Three rotating shafts are provided in the center of a plane of the dial 3, and the seconds hand 4, the minute hand 5, and the hour hand 6 are respectively attached to the rotating shafts. Note that a surface of the dial 3 is an example of a display surface of the present disclosure.

The pointers 4 to 6 normally display time. However, when the A button 9A is pressed for a predetermined period of time, for example, three seconds or longer and shorter than six seconds, and a compass mode is set, the seconds hand 4 displays a bearing of the north. In other words, the seconds hand 4 is an example of a first pointer of the present disclosure.

Further, the functional hand 7 is attached to the dial 3 in a 6 o'clock direction with respect to the center of the plane when viewed from a watch surface side, and an indicator 12 indicating magnetic intensity is displayed between the functional hand 7 and the center of the plane.

The functional hand 7 normally points to a "0" position of the indicator 12, but, when the compass mode is set, it points to the indicator 12 in accordance with the magnetic intensity. In other words, the functional hand 7 is an example of a second pointer of the present disclosure. Note that the functional hand 7 is not limited to pointing to only the magnetic intensity, and may also be configured to be able to point to various types of information such as a battery amount.

As the indicator 12, an arc, "0", "10", "20", "30", and "40", which are numerical values indicating the magnetic intensity, and "μT", which is a symbol indicating a unit of the magnetic intensity, are displayed. With these, a user can recognize the magnetic intensity pointed by the functional hand 7.

Furthermore, as an indicator 12, alphabetic characters of "L" and "H" and dotted lines indicating widths thereof are indicated. The "L" and the dotted line indicating the width thereof represent a region in which magnetic intensity of a geomagnetic field is low, and the "H" and the dotted line indicating the width thereof represent a region in which magnetic intensity that is possible for a geomagnetic field is exceeded. In this way, when the compass mode is set, the user can intuitively perceive that the accuracy of a bearing of the north pointed by the seconds hand 4 is low and that there is an abnormality in a magnetic offset value described later.

Further, the movement 10 is housed in the outer case 2. Then, a biaxial magnetic sensor 11 is provided in the movement 10. The biaxial magnetic sensor 11 is disposed between a 6 o'clock scale and a 7 o'clock scale when viewed from the watch surface.

The biaxial magnetic sensor 11 is a biaxial type magnetic sensor that measures magnetism and acquires a detection value. In other words, the biaxial magnetic sensor 11 is an example of a magnetic sensor of the present disclosure.

Further, in FIG. 1, the biaxial magnetic sensor 11 includes a first detection axis 111 extending along an X direction and a second detection axis 112 extending along a Y direction orthogonal to the X direction. In other words, the first detection axis 111 and the second detection axis 112 are orthogonal to each other, and are disposed in a plane parallel to the dial 3. In this way, the biaxial magnetic sensor 11 is configured to be able to measure a horizontal component of a geomagnetic field when the dial 3 of the electronic watch 1 is maintained horizontally.

Note that, as illustrated in FIG. 1, the X direction is a direction from a 9 o'clock scale to a 3 o'clock scale of the dial 3, and the Y direction is a direction from the 6 o'clock scale to a 12 o'clock scale.

Here, the case in which the first detection axis 111 and the second detection axis 112 are orthogonal to each other is not limited to a case in which the first detection axis 111 and the second detection axis 112 are completely orthogonal to each other, and also includes a case in which, for example, an angle of intersection between the first detection axis 111 and the second detection axis 112 is offset from 900 by a few degrees. This means that an influence of the assembly accuracy of the axis of the biaxial magnetic sensor 11 and the like is acceptable.

Further, the case in which the first detection axis 111 and the second detection axis 112 are disposed in the plane parallel to the dial 3 is not limited to a case in which the first detection axis 111 and the second detection axis 112 are disposed in the plane completely parallel to the dial 3, and also includes a case in which, for example, an angle of intersection between the plane parallel to the dial 3 and the first detection axis 111 is approximately a few degrees due to an influence of the assembly accuracy of the movement 10 and the like. Similarly, a case in which an angle of intersection between the plane parallel to the dial 3 and the second detection axis 112 is approximately a few degrees is also included.

Configuration of Movement

FIG. 2 is a block diagram illustrating a configuration of the movement 10.

The movement 10 includes the biaxial magnetic sensor 11, a seconds hand motor 21, an hour-minute hand motor 22, a functional hand motor 23, a seconds hand train wheel 24, an hour-minute hand train wheel 25, and a functional hand train wheel 26. Furthermore, the movement 10 includes a CPU 31, an RTC 32, a seconds hand driver 33, an hour-minute hand driver 34, a functional hand driver 35, a crown operation detection unit 36, a button operation detection unit 37, a RAM 38, and a ROM 39.

Note that CPU is an abbreviation for a "central processing unit", RTC is an abbreviation for a "real-time clock", RAM is an abbreviation for a "random access memory", and ROM is an abbreviation for a "read only memory".

The seconds hand motor 21, the hour-minute hand motor 22, and the functional hand motor 23 are formed of, for example, a bipolar stepping motor.

The seconds hand train wheel 24 is formed of a plurality of gears, and moves the seconds hand 4 in conjunction with a rotor (not illustrated) of the seconds hand motor 21.

The hour-minute train wheel 25 is formed of a plurality of gears, and moves the minute hand 5 and the hour hand 6 in conjunction with a rotor (not illustrated) of the hour-minute hand motor 22.

The functional hand train wheel 26 is formed of a plurality of gears, and moves the functional hand 7 in conjunction with a rotor (not illustrated) of the functional hand motor 23.

The seconds hand driver 33, the hour-minute hand driver 34, and the functional hand driver 35 output a motor drive current to corresponding motors in accordance with a signal from the CPU 31.

The crown operation detection unit 36 detects an operation of the crown 8, and outputs an operation signal in accordance with the operation to the CPU 31.

The button operation detection unit 37 detects an operation of the A button 9A and the B button 9B, and outputs an operating signal in accordance with the operation to the CPU 31.

The ROM 39 stores a program executed by the CPU 31, and the like.

The RAM 38 stores data necessary for the CPU 31 to perform processing, and the like. For example, a magnetic offset value indicating an offset magnetic field occurring in the watch is stored.

The CPU 31 functions as a mode setting unit 311, a bearing measurement unit 312, a correction unit 313, a calculation unit 314, a display unit 315, and a calibration unit 316 by executing the program stored in the ROM 39.

Mode Setting Unit

The mode setting unit 311 sets a normal mode of displaying time, a compass mode of measuring and displaying a bearing, and a calibration mode of acquiring the magnetic offset value, in accordance with an operation of the crown 8, the A button 9A, and the B button 9B.

In the present exemplary embodiment, for example, when the A button 9A is pressed for three seconds or longer and shorter than six seconds while the normal mode is set, the mode setting unit 311 sets the mode to the compass mode. Further, when the A button 9A is pressed while the compass mode is set, the mode setting unit 311 releases the compass mode. In other words, the mode setting unit 311 sets the mode to the normal mode. Furthermore, when the B button 9B is pressed for six seconds or longer while the compass mode is set, the mode setting unit 311 sets the mode to the calibration mode.

Bearing Measurement Unit

When the compass mode is set by the mode setting unit 311, the bearing measurement unit 312 actuates the biaxial magnetic sensor 11, and then measures magnetism and acquires a detection value. Specifically, "$B_{XRAW}$" being a detection value in a direction of the first detection axis 111 of the biaxial magnetic sensor 11, namely, in an X-axis direction illustrated in FIG. 1, and "$B_{YRAW}$" being a detection value in a direction of the second detection axis 112, namely, in a Y-axis direction are acquired.

In the present exemplary embodiment, a magnetic measurement by the bearing measurement unit 312 is performed at a prescribed interval, for example, every one second. Then, the bearing measurement unit 312 terminates the magnetic measurement by the biaxial magnetic sensor 11 when a predetermined period of time, for example, one minute has elapsed since the start of the magnetic measurement by the biaxial magnetic sensor 11.

Note that, when the magnetic measurement by the bearing measurement unit 312 is terminated as described above, the mode setting unit 311 releases the compass mode and sets the mode to the normal mode.

Correction Unit

The correction unit 313 reads a magnetic offset value from the RAM 38, and corrects the detection value acquired by the bearing measurement unit 312, based on the magnetic offset value. Specifically, by subtracting "$B_{XOff}$" being a magnetic offset value in an axial direction of the first detection axis 111, namely, in the X-axis direction illustrated in FIG. 1 and "$B_{YOff}$" being a magnetic offset value in an axial direction of the second detection axis 112, namely, in the Y-axis direction from the detection values "$B_{XRAW}$, $B_{YRAW}$", values "$B_X$, $B_Y$" after offset correction are acquired.

Calculation Unit

The calculation unit 314 calculates a bearing and magnetic intensity, based on the values acquired by correcting the detection values by the correction unit 313. Specifically, the calculation unit 314 calculates a square root of "$B_X^2+B_Y^2$", that is, calculates magnetic intensity |B| by acquiring magnitude of a vector. Further, the calculation unit 314 calculates a bearing of the north from a direction of the vector of the values "$B_X$, $B_Y$" after the offset correction.

Display Unit

The display unit 315 controls display by the seconds hand 4, the minute hand 5, the hour hand 6, and the functional hand 7 by controlling the seconds hand driver 33, the hour-minute hand driver 34, and the functional hand driver 35.

Specifically, when the normal mode is set by the mode setting unit 311, the display unit 315 cause the pointers 4 to 6 to display time by controlling the seconds hand driver 33 and the hour-minute hand driver 34. Further, as described above, when the normal mode is set, the display unit 315 causes the functional hand 7 to point to the "0" position of the indicator 12 by controlling the functional hand driver 35.

Further, when the compass mode is set by the mode setting unit 311, the display unit 315 causes the seconds hand 4 to point to the bearing of the north by controlling the seconds hand driver 33 based on the calculation result from the calculation unit 314. Furthermore, the display unit 315 causes the functional hand 7 to point to the magnetic intensity |B| by controlling the functional hand driver 35 based on the calculation result from the calculation unit 314.

Calibration Unit

When the calibration mode is set, the calibration unit 316 measures magnetism by controlling the biaxial magnetic sensor 11, and thus calculates and acquires a magnetic offset value.

Specifically, when the electronic watch 1 is maintained horizontally by the user and, for example, the B button 9B is pressed while the calibration mode is set, the calibration unit 316 actuates the biaxial magnetic sensor 11 and measures the magnetism. Subsequently, when the user rotates the electronic watch 1 by 180° while maintaining the electronic watch 1 horizontally, and then the B button 9B is pressed again, the calibration unit 316 actuates the biaxial magnetic sensor 11 and measures the magnetism.

Here, when an offset magnetic field affects a measurement value of the magnetism, a first measurement value and a second measurement value have the same value of an offset magnetic field component, whereas the first measurement value and the second measurement value have the same value of a geomagnetic component with reverse polarity. Thus, the calibration unit 316 acquires a magnetic offset value from which the geomagnetic component is removed by calculating and acquiring an average value of the first measurement value and the second measurement value. Then, the calibration unit 316 stores the acquired magnetic offset values "$B_{XOff}$, $B_{YOff}$" in the RAM 38.

Subsequently, when the A button 9A is pressed, the mode setting unit 311 releases the calibration mode and sets the mode to the normal mode. In this way, the calibration operation is terminated.

Operation of Compass Mode

Next, an operation of the compass mode will be described.

As described above, when the compass mode is set by the mode setting unit 311, the bearing measurement unit 312 actuates the biaxial magnetic sensor 11, and then measures magnetism and acquires a detection value. Then, the correction unit 313 corrects the detection value by a magnetic offset value. The calculation unit 314 calculates a bearing of the north and magnetic intensity |B|, based on a value after the offset correction. The display unit 315 causes the calculated bearing of the north and the calculated magnetic intensity |B| to be displayed by the seconds hand 4 and the functional hand 7.

Here, in a case in which there is no error in the magnetic offset value, that is, in a case in which the detection value is corrected without error, when the user rotates the electronic watch 1 while maintaining the electronic watch 1 horizontally, the values "$B_X$, $B_Y$" after the offset correction describe a circle having intensity of a horizontal component of the geomagnetic field as a radius with the origin as the center. In other words, in a case in which the correction by the magnetic offset value is performed without error, the magnetic intensity |B| pointed by the functional hand 7 does not change even when the user directs the electronic watch 1 in various directions.

In contrast, in a case in which there is an error in the magnetic offset value, when the user rotates the electronic watch 1 while maintaining the electronic watch 1 horizontally, the values "$B_X$, $B_Y$" after the offset correction describe a circle having intensity of a horizontal component of the geomagnetic field as a radius with, as the center, a point deviated from the origin by the error in the magnetic offset value. In other words, when there is an error in the magnetic offset value, the magnetic intensity |B| pointed by the functional hand 7 changes depending on a direction of the electronic watch 1.

In this way, the user can perceive occurrence of an error in the currently acquired magnetic offset value, and can thus determine that the calibration operation needs to be performed.

Advantageous Effects of First Exemplary Embodiment

According to the present exemplary embodiment, the following advantageous effects can be acquired.

In the present exemplary embodiment, the electronic watch 1 includes the biaxial magnetic sensor 11 in which the first detection axis 111 and the second detection axis 112 are disposed in the plane parallel to the dial 3. Then, the electronic watch 1 includes the correction unit 313 that corrects an error caused by an offset magnetic field included in a detection value of the biaxial magnetic sensor 11, the calculation unit 314 that calculates a bearing and magnetic intensity |B|, based on a value acquired by correcting the detection value by the correction unit 313, and the display unit 315 that causes the bearing and the magnetic intensity |B| calculated by the calculation unit 314 to be displayed on the dial 3.

In this way, the user can perceive the intensity of the horizontal component of the geomagnetic field from which a magnetic offset value indicating the offset magnetic field is removed, along with the bearing. Thus, the user can perceive a change in accuracy when a bearing is measured in an area in which a horizontal component of the geomagnetic field is small and a place where intensity of the geomagnetic field is specifically low, for example. In other words, the user can determine whether or not a bearing pointed by the seconds hand 4 is highly reliable. Furthermore, when the magnetic intensity |B| is greater than the intensity of the geomagnetic field present on the Earth, the user can assume that an object emitting great magnetism is present in the vicinity, that calibration needs to be performed due to a great error in a magnetic offset value, and that some sort of problem occurs in a bearing measurement.

Further, in the present exemplary embodiment, the user can determine whether or not an error occurs in a currently acquired magnetic offset value by maintaining the electronic watch 1 horizontally and rotating the electronic watch 1 while the compass mode is set, and checking magnetic intensity pointed by the functional hand 7. Thus, the user can determine that the calibration operation needs to be performed.

In the present exemplary embodiment, the seconds hand 4 that displays a bearing and the functional hand 7 that displays magnetic intensity are provided. Thus, a bearing and magnetic intensity can be perceived simultaneously. As a result, for example, when pointing of a bearing by the seconds hand 4 suddenly changes, it is possible to easily determine whether or not the change is caused by a change in the magnetic intensity. For example, when an apparatus that generates magnetism is present in the vicinity, it is possible to immediately perceive an abnormality in the magnetism.

In the present exemplary embodiment, the indicator 12 indicating magnetic intensity is displayed on the dial 3. Thus, the user can easily perceive the magnetic intensity from the indicator 12 and the functional hand 7. Furthermore, the user can easily determine whether or not it is a magnetic condition in which a bearing measurement can be appropriately performed.

Second Exemplary Embodiment

Next, a second exemplary embodiment will be described below with reference to FIGS. 3 to 5.

The second exemplary embodiment is different from the first exemplary embodiment described above in that an electronic watch 1A is not provided with a functional hand that points to magnetic intensity and an indicator of the magnetic intensity is not displayed on a dial 3A. Further, the second exemplary embodiment is different from the first exemplary embodiment in that the electronic watch 1A is provided with a triaxial magnetic sensor 11A and an acceleration sensor 13A.

Note that the same configuration as that of the electronic watch 1 in the first exemplary embodiment will be provided with the same reference numeral, and description will be omitted.

Figure 3:
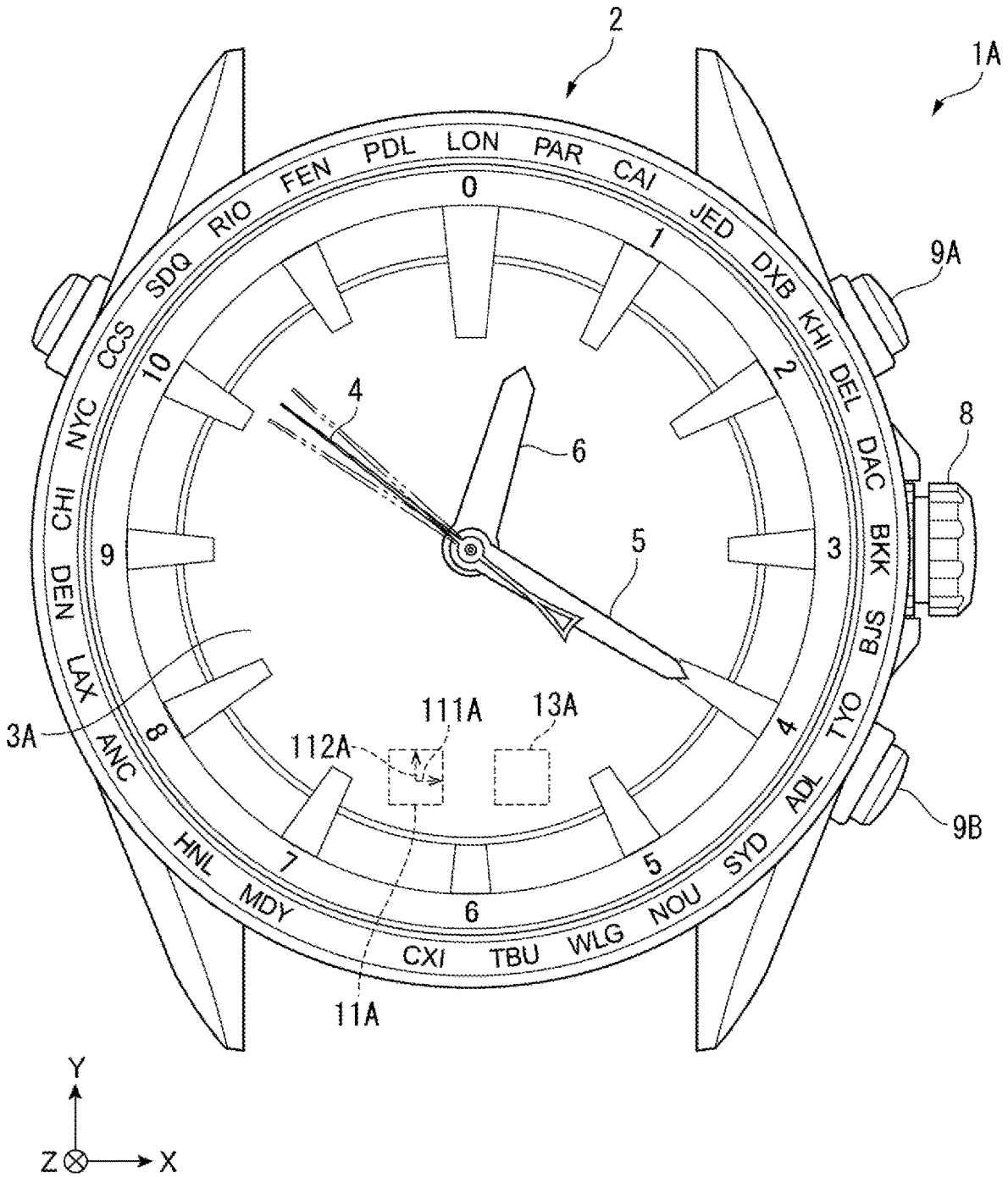
FIG. 3 is a front view illustrating an electronic watch according to a second exemplary embodiment.

FIG. 3 is a front view illustrating the electronic watch 1A.

As illustrated in FIG. 3, the triaxial magnetic sensor 11A is provided on a movement 10A housed in an outer case 2. The triaxial magnetic sensor 11A is disposed between a 6 o'clock scale and a 7 o'clock scale when viewed from a watch surface.

The triaxial magnetic sensor 11A is a triaxial type magnetic sensor that measures magnetism and acquires a detection value. In other words, the triaxial magnetic sensor 11A is an example of a magnetic sensor of the present disclosure.

Further, in FIG. 3, the triaxial magnetic sensor 11A includes a first detection axis 111A extending along an X direction, a second detection axis 112A extending along a Y direction orthogonal to the X direction, and a third detection axis (not illustrated) extending along a Z direction orthogonal to the X direction and the Y direction. In other words, the third detection axis is orthogonal to the first detection axis 111A and the second detection axis 112A. In this way, the triaxial magnetic sensor 11A is configured to be able to measure a geomagnetic field of a vertical component in addition to a horizontal component.

Note that, as illustrated in FIG. 3, a Z-axis direction is a direction from the dial 3A toward a case back along rotating shafts of pointers 4 to 6.

Further, the case in which the third detection axis is orthogonal to the first detection axis 111A and the second detection axis 112A is not limited to a case in which the third detection axis is completely orthogonal to the first detection axis 111A and the second detection axis 112A, and also includes a case in which, for example, an angle of intersection between the third detection axis and the first detection axis 111A is offset from 900 by a few degrees. Similarly, a case in which an angle of intersection between the third detection axis and the second detection axis 112A is offset from 900 by a few degrees is also included.

Further, the acceleration sensor 13A is provided in the movement 10A. The acceleration sensor 13A is disposed between a 5 o'clock scale and the 6 o'clock scale when viewed from the watch surface.

The acceleration sensor 13A is configured to be able to detect gravitational acceleration, and is configured to be able to detect an inclination of the outer case 2 from a direction of the gravitational acceleration. In the present exemplary embodiment, as described later, a measurement value of the acceleration sensor 13A is used to separate a horizontal component and a vertical component from a magnetic measurement value acquired by the triaxial magnetic sensor 11A.

Configuration of Movement

Figure 4:
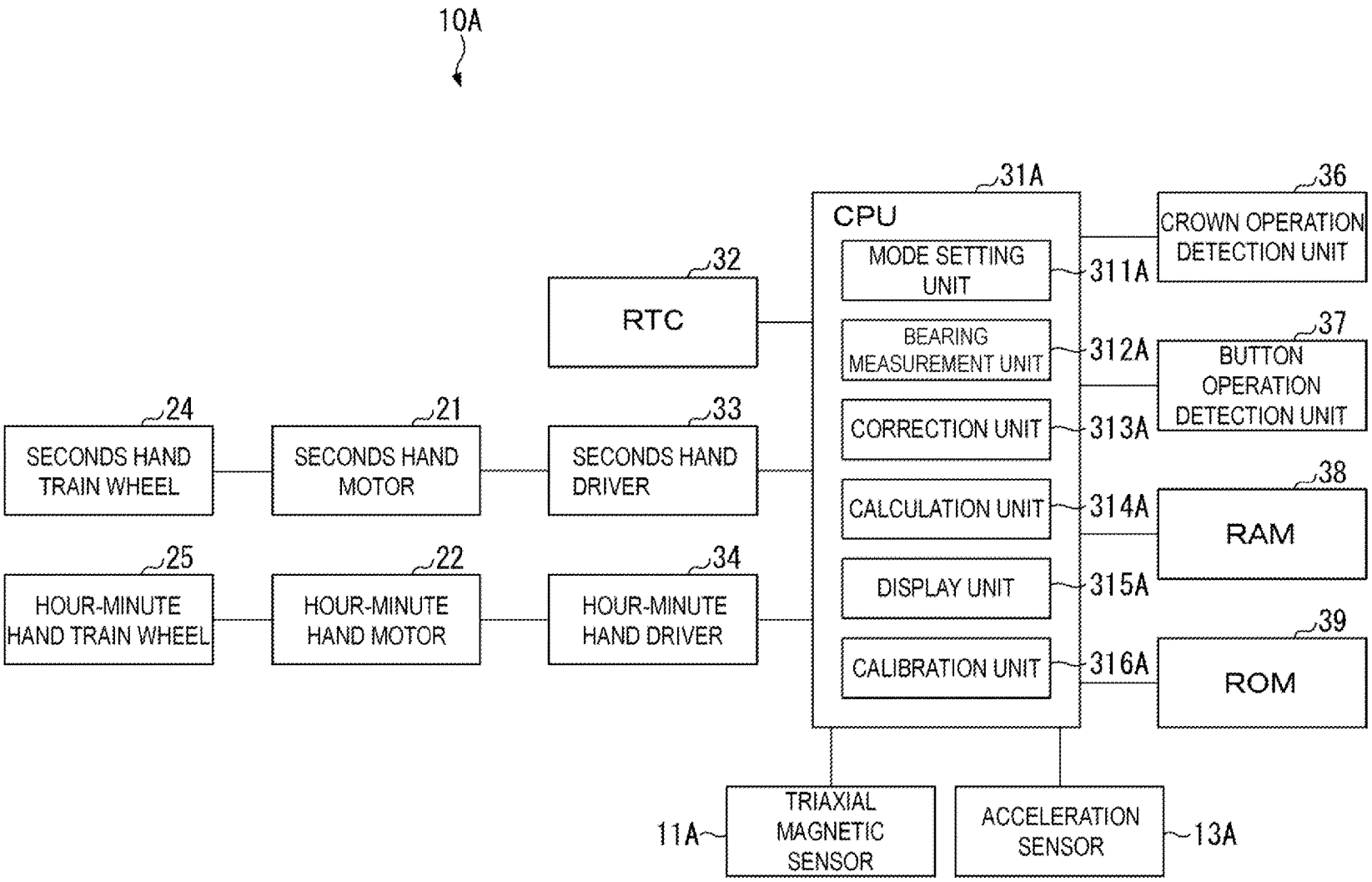
FIG. 4 is a block diagram illustrating a schematic configuration of the electronic watch according to the second exemplary embodiment.

FIG. 4 is a block diagram illustrating a configuration of the movement 10A.

The movement 10A includes the triaxial magnetic sensor 11A, the acceleration sensor 13A, and a CPU 31A. Note that, since the functional hand is not provided in the second exemplary embodiment, the movement 10A is not provided with a functional hand train wheel, a functional hand motor, and a functional hand driver.

The CPU 31A functions as a mode setting unit 311A, a bearing measurement unit 312A, a correction unit 313A, a calculation unit 314A, a display unit 315A, and a calibration unit 316A by executing a program stored in a ROM 39.

Bearing Measurement Unit

The bearing measurement unit 312A acquires "$B_{XRAW}$" being a detection value in an axial direction of the first detection axis 111A of the triaxial magnetic sensor 11A, "$B_{YRAW}$" being a detection value in an axial direction of the second detection axis 112A, and "$B_{ZRAW}$" being a detection value in the Z direction in FIG. 3.

Correction Unit

The correction unit 313A reads "$B_{XOff}$", "$B_{YOff}$", and "$B_{ZOff}$", which is a magnetic offset value in the Z-axis direction, from a RAM 38, corrects the detection values acquired by the bearing measurement unit 312A, based on the magnetic offset values, and acquires values "$B_X$, $B_Y$, $B_Z$" after the offset correction. Note that, in the present exemplary embodiment, the calibration unit 316A is configured to actuate the triaxial magnetic sensor 11A, and be able to acquire magnetic offset values in the X, Y, and Z-axis directions when the calibration mode is set.

Calculation Unit

The calculation unit 314A separates horizontal components "$B_{HX}$, $B_{HY}$" and a vertical component "$B_{VZ}$" from the values "$B_X$, $B_Y$, $B_Z$" after the offset correction, based on a measurement value of the acceleration sensor 13A. Note that a method for separating horizontal components of a measurement value of the triaxial magnetic sensor 11A by using a measurement value of the acceleration sensor 13A is a known technique, and thus detailed description will be omitted. For example, the horizontal components can be separated by multiplying the corrected values "$B_X$, $B_Y$, $B_Z$" by a rotation matrix based on the measurement value of the acceleration sensor 13A.

Then, the calculation unit 314A calculates magnetic intensity |B| and a bearing of the north in the horizontal plane from the separated horizontal components "$B_{HX}$, $B_{HY}$".

In the present exemplary embodiment, when the compass mode is set by the mode setting unit 311A, the display unit 315A controls a seconds hand driver 33 based on the calculation result from the calculation unit 314A such that the seconds hand 4 points to a bearing of the north and magnetic intensity.

Specifically, as illustrated in FIG. 3, the display unit 315A changes an amplitude of the seconds hand 4 while causing the seconds hand 4 to point to a bearing of the north, and thus causes magnetic intensity to be displayed by the amplitude.

FIG. 5 is a diagram illustrating a relationship between magnetic intensity and an amplitude of the seconds hand 4.

As illustrated in FIG. 5, when the magnetic intensity |B| is smaller than 15 μT, the display unit 315A reciprocates the seconds hand 4 at an amplitude of 4 steps. When the magnetic intensity |B| is greater than or equal to 15 μT and less than 25 μT, the display unit 315A reciprocates the seconds hand 4 at an amplitude of 3 steps. When the magnetic intensity |B| is greater than or equal to 25 μT and less than 35 μT, the display unit 315A reciprocates the seconds hand 4 at an amplitude of 2 steps. Further, when the magnetic intensity |B| is greater than or equal to 35 μT and less than 45 μT, the display unit 315A reciprocates the seconds hand 4 at an amplitude of 1 step.

Further, since a geomagnetic field having the magnetic intensity |B| of greater than or equal to 45 μT is rarely present on the Earth, the display unit 315A reciprocates the seconds hand 4 at an amplitude of 0 step, that is, does not reciprocate the seconds hand 4 when the magnetic intensity |B| is greater than or equal to 45 μT.

In this way, in the present exemplary embodiment, the display unit 315A changes an amplitude of the seconds hand 4 in accordance with magnetic intensity.

Note that a configuration of the display unit 315A is not limited to the above-described configuration. For example, the display unit 315A may reciprocate the seconds hand 4 at an amplitude greater than 4 steps when the magnetic intensity |B| is smaller than 15 μT. Further, when the magnetic intensity |B| is greater than or equal to 45 μT, the display unit 315A may cause the seconds hand 4 to rotate one time clockwise and then rotate the seconds hand 4 one time counterclockwise.

The magnetic intensity |B| is calculated from the horizontal components "$B_{HX}$, $B_{HY}$" in the description above, but intensity of total magnetism of the geomagnetic field may be calculated by using the values "$B_X$, $B_Y$, $B_Z$" after the offset correction. In this case, a range of the total magnetism observed on the Earth is also limited, and thus the user can be notified that there is an abnormality in a magnetic measurement value.

Advantageous Effects of Second Exemplary Embodiment

According to the present exemplary embodiment, the following advantageous effects can be acquired.

In the present exemplary embodiment, the display unit 315A causes the seconds hand 4 to display magnetic intensity by changing an amplitude of the seconds hand 4 in accordance with the magnetic intensity.

In this way, the user can perceive low magnetic intensity when the amplitude of the seconds hand 4 is great, that is, when the seconds hand 4 ambiguously points to a bearing of the north, and perceive high magnetic intensity when the amplitude of the seconds hand 4 is small, that is, when the seconds hand 4 explicitly points to a bearing of the north. Thus, the user can intuitively perceive the accuracy of the bearing measurement.

Further, since both a bearing and magnetic intensity can be pointed by the seconds hand 4, a pointer and a train wheel, a motor, a driver, and the like that drive the pointer can be reduced as compared with when a bearing and magnetic intensity are pointed by different pointers. As a result, the number of parts can be reduced. Furthermore, since a pointer that points to magnetic intensity is not provided, a simple design can be achieved.

In the present exemplary embodiment, the electronic watch 1A includes the triaxial magnetic sensor 11A and the acceleration sensor 13A. In this way, a bearing measurement can be performed based on magnetic intensity in directions of three axes, and a horizontal component can be separated based on the result. Thus, for example, even when the user cannot maintain the electronic watch 1A horizontally, a bearing and magnetic intensity can be accurately calculated.

Modification Example

Note that the present disclosure is not limited to each of the exemplary embodiments described above, and variations, modifications, and the like within the scope in which the object of the present disclosure can be achieved are included in the present disclosure.

Figure 6:
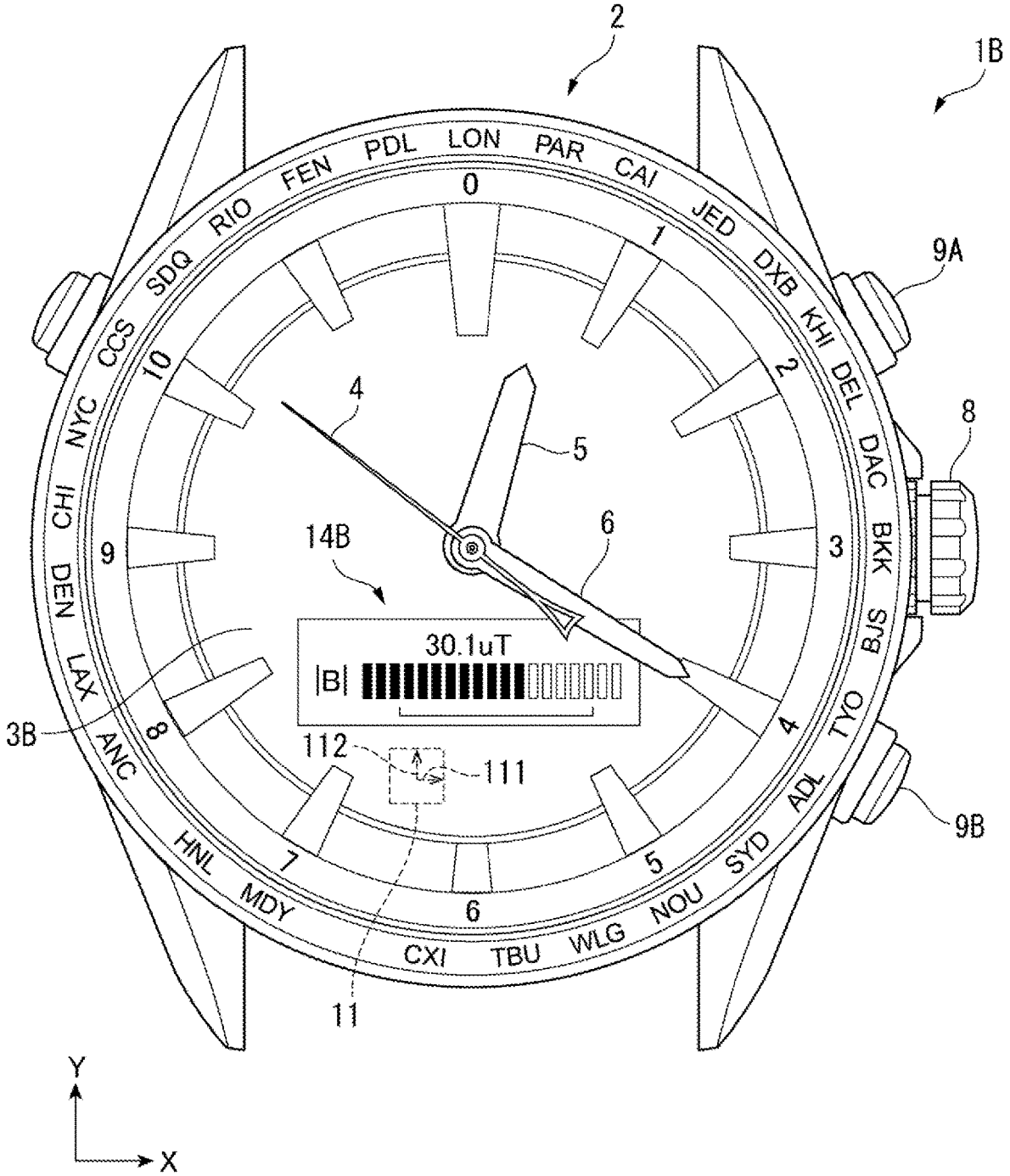
FIG. 6 is a front view illustrating an electronic watch according to a modification example.

FIG. 6 is a front view illustrating an electronic watch 1B according to a modification example.

As illustrated in FIG. 6, in the electronic watch 1B, a liquid crystal display unit 14B that displays magnetic intensity may be provided on a dial 3B. Further, a bar graph that displays magnetic intensity and a numerical value of the magnetic intensity may also be displayed on the liquid crystal display unit 14B. Furthermore, a mark indicating a range of appropriate magnetic intensity may be indicated along with the bar graph. With such a configuration, the user can also perceive intensity of a horizontal component of a geomagnetic field along with a bearing. Thus, the user can determine whether or not a bearing pointed by a seconds hand 4 is highly reliable. Note that any one of the bar graph and the numerical value described above may be displayed on the liquid crystal display unit 14B.

Figure 7:
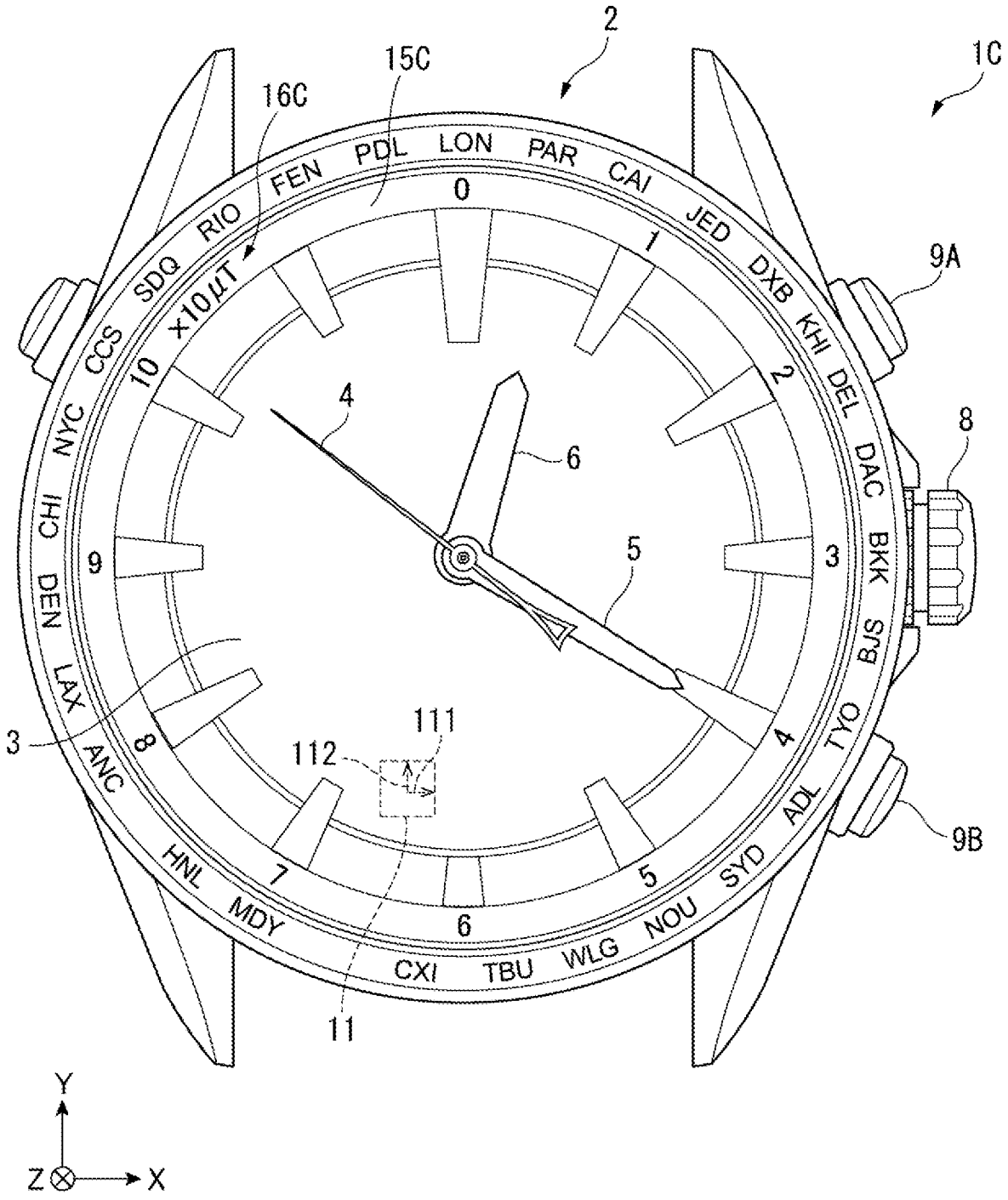
FIG. 7 is a front view illustrating an electronic watch according to another modification example.

FIG. 7 is a front view illustrating an electronic watch 1C according to another modification example.

As illustrated in FIG. 7, in the electronic watch 1C, an indicator 16C indicating magnetic intensity may be displayed on a dial ring 15C. A numerical value representing magnetic intensity and a symbol representing a unit may be displayed as the indicator 16C. Then, the electronic watch 1C may be configured to be able to switch pointing by a seconds hand 4 between a bearing and magnetic intensity when, for example, a B button 9B is operated while the compass mode is set. Note that the B button 9B is an example of an operation unit.

As an example, when the B button 9B is pressed for three seconds or longer while the seconds hand 4 points to a bearing, the electronic watch 10C switches the seconds hand 4 so as to point to magnetic intensity. In this case, the magnetic intensity is pointed by using the indicator 16C displayed on the dial ring 15C. Then, when the B button 9B is pressed again while the seconds hand 4 points to the magnetic intensity, the electronic watch 1C switches the seconds hand 4 so as to point to the bearing. In this way, since both a bearing and magnetic intensity can be pointed by the seconds hand 4, the number of parts can be reduced as compared with when a bearing and magnetic intensity are pointed by different pointers, and a simple design can be achieved.

In the first exemplary embodiment, the movement 10 is configured to include the biaxial magnetic sensor 11 of the biaxial type, which is not limited thereto. For example, the movement 10 may also be configured to include a triaxial magnetic sensor of a triaxial type. Furthermore, the movement 10 may also include an acceleration sensor. When the movement 10 includes a triaxial magnetic sensor and an acceleration sensor, a bearing and magnetic intensity can be accurately calculated even when the user cannot maintain the electronic watch 1 horizontally, similarly to the second exemplary embodiment described above.

In the second exemplary embodiment, the movement 10A is configured to include the triaxial magnetic sensor 11A, which is not limited thereto. For example, the movement 10A may also be configured to include a biaxial magnetic sensor. Further, in this case, the movement 10A may not include the acceleration sensor 13A.

Furthermore, the triaxial magnetic sensor 11A and the acceleration sensor 13A are provided separately, but may be formed of the same part, that is, may be packaged in one package.

In each of the exemplary embodiments described above, the electronic watches 1 and 1A are formed as an analog electronic watch that displays time by the pointers 4 to 6, which is not limited thereto. For example, the electronic watches 1 and 1A may be formed as a digital electronic watch that displays time on a liquid crystal display unit, and may be configured so as to display a bearing and magnetic intensity on the liquid crystal display unit.

In each of the exemplary embodiments described above, the electronic watches 1 and 1A are configured to be able to display a bearing of the north as magnetic north, which is not limited thereto. For example, the electronic watches 1 and 1A may be configured to be able to acquire declination of a current location, and may be configured to be able to calculate and display a bearing of due north by correcting the calculated bearing of the north with the declination.

Further, the electronic watches 1 and 1A may be configured so as to display intensity of magnetic intensity by using a light source. For example, a plurality of LEDs may be disposed on the dials 3 and 3A, and the electronic watches 1 and 1A may be configured so as to display intensity of magnetic intensity with the number of illuminated LEDs. Further, the electronic watches 1 and 1A may also be configured so as to display intensity of magnetic intensity by an LED illuminated in color, for example, red, yellow, or blue. Alternatively, one light source may be provided, and the electronic watches 1 and 1A may be configured so as to display intensity of magnetic intensity by a flash speed of the light source.

What is claimed is:

1. An electronic watch, comprising:

a display surface;

a magnetic sensor including a first detection axis and a second detection axis orthogonal to the first detection axis, the first detection axis and the second detection axis being disposed in a plane parallel to the display surface; and a CPU configured to correct an error, due to an offset magnetic field, included in a detection value of the magnetic sensor, calculate a bearing and magnetic intensity, based on a value acquired by correcting the detection value, and cause the display surface to display the calculated bearing and the calculated magnetic intensity, wherein the display surface includes a first pointer configured to indicate the bearing and the magnetic intensity, and the CPU indicates the bearing by a pointing direction of the first pointer, and indicates the magnetic intensity using the first pointer by changing an amplitude of a reciprocating movement of the first pointer in accordance with the magnetic intensity.

2. The electronic watch according to claim 1, wherein the display surface includes a first pointer configured to indicate the bearing and a second pointer configured to indicate the magnetic intensity, and the CPU causes the first pointer and the second pointer to indicate the calculated bearing and the calculated magnetic intensity, respectively.

3. The electronic watch according to claim 2, wherein the display surface includes an indicator configured to indicate the magnetic intensity.

4. The electronic watch according to claim 1, comprising:

a first pointer configured to indicate the bearing and the magnetic intensity; and an operation unit that receives an operation of switching between a normal mode of displaying time and a compass mode of calculating and displaying the bearing and the magnetic intensity, wherein the CPU indicates the bearing by the first pointer when the mode is switched to the compass mode, and indicates the magnetic intensity instead of the bearing by the first pointer when the operation unit is operated while the first pointer is indicating the bearing.

5. An electronic watch, comprising:

a display surface;

a magnetic sensor including a first detection axis and a second detection axis orthogonal to the first detection axis, the first detection axis and the second detection axis being disposed in a plane parallel to the display surface;

a CPU configured to correct an error, due to an offset magnetic field, included in a detection value of the magnetic sensor, calculate a bearing and magnetic intensity, based on a value acquired by correcting the detection value, and cause the display surface to display the calculated bearing and the calculated magnetic intensity;

a first pointer configured to indicate the bearing and the magnetic intensity; and an operation unit that receives an operation of switching between a normal mode of displaying time and a compass mode of calculating and displaying the bearing and the magnetic intensity, wherein the CPU indicates the bearing by the first pointer when the mode is switched to the compass mode, and indicates the magnetic intensity instead of the bearing by the first pointer when the operation unit is operated while the first pointer is indicating the bearing.

6. The electronic watch according to claim 5, wherein the display surface includes a first pointer configured to indicate the bearing and a second pointer configured to indicate the magnetic intensity, and the CPU causes the first pointer and the second pointer to indicate the calculated bearing and the calculated magnetic intensity, respectively.

7. The electronic watch according to claim 6, wherein the display surface includes an indicator configured to indicate the magnetic intensity.

8. The electronic watch according to claim 5, wherein the display surface includes a first pointer configured to indicate the bearing and the magnetic intensity, and the CPU indicates the bearing by a pointing direction of the first pointer, and indicates the magnetic intensity using the first pointer by changing an amplitude of a reciprocating movement of the first pointer in accordance with the magnetic intensity.

* * * * *